US012751585B2

(12) United States Patent
Lu

(10) Patent No.: US 12,751,585 B2
(45) Date of Patent: Oct. 6, 2026

(54) SOAP DISPENSER WITH DETACHABLE LIQUID STORAGE BOTTLE

(71) Applicant: Sai Lu, Guangzhou City (CN)

(72) Inventor: Sai Lu, Guangzhou City (CN)

( * ) Notice: Subject to any disclaimer, the term of this patent is extended or adjusted under 35 U.S.C. 154(b) by 185 days.

(21) Appl. No.: 18/745,117

(22) Filed: Jun. 17, 2024

(65) Prior Publication Data

US 2025/0325150 A1 Oct. 23, 2025

(30) Foreign Application Priority Data

Apr. 19, 2024 (CN) ..... 202420828586.X

(51) Int. Cl.
*A47K 5/13* (2006.01)
*A47K 5/12* (2006.01)

(52) U.S. Cl.
CPC ..... *A47K 5/13* (2013.01); *A47K 5/1214* (2013.01)

(58) Field of Classification Search
CPC ..... A47K 5/13; A47K 5/1214; A47K 5/12; A47K 5/1202
USPC ..... 222/173, 180, 181.1, 181.2, 181.3, 182
See application file for complete search history.

(56) References Cited

U.S. PATENT DOCUMENTS 4,429,812 A * 2/1984 Steiner ..... A47K 5/1208 141/18
5,033,657 A * 7/1991 Whittington ..... B67D 1/10 222/309
5,174,476 A * 12/1992 Steiner ..... A47K 5/1209 222/189.09
5,373,970 A * 12/1994 Ophardt ..... A47K 5/1207 222/325
5,556,005 A * 9/1996 Banks ..... A47K 5/1204 222/105

* cited by examiner

*Primary Examiner* — David J Walczak

(57) ABSTRACT

A soap dispenser with a detachable liquid storage bottle, relating to the technical field of soap dispensers. The soap dispenser includes a shell, a fixed seat, a pump head, and the liquid storage bottle, where both the liquid storage bottle and the pump head are installed inside the shell, the soap dispenser further includes a lifting mechanism, the liquid storage bottle includes a positioning cover, the lifting mechanism is connected to the positioning cover in a repeatably detachable manner, the liquid storage bottle further includes a butting pipe, and a liquid inlet pipe communicates with the liquid storage bottle via the butting pipe, and the liquid inlet communicates with the butting pipe in a repeatably openable and closable manner.

16 Claims, 16 Drawing Sheets

SOAP DISPENSER WITH DETACHABLE LIQUID STORAGE BOTTLE

CROSS REFERENCE TO RELATED APPLICATION

This application claims priority benefit of Chinese patent Application No. 202420828586. X, filed on Apr. 19, 2024, No. 202421095109.3, filed on May 17, 2024, and the entire contents of which are incorporated herein by reference

TECHNICAL FIELD

The present disclosure belongs to the technical field of soap dispensers, and particularly relates to a soap dispenser with a detachable liquid storage bottle.

BACKGROUND

A press-type soap dispenser is a common washing appliance in a kitchen or bathroom, which is usually installed on a wall beside a faucet of a water tank, and liquid is discharged by pressing and rotating a switch connected to a main body of the soap dispenser. The press-type soap dispenser is the best hand-washing and cleaning tool to prevent cross-infection and diseases from entering the hands in modern life, and is one of the important symbols of the progress of human society and the improvement of the quality of life.

The invention patent with the patent number of ZL202320678895.9 discloses a pump head, and the pump head mentioned in the present application may refer to the pump head of the present disclosure.

Most of the liquid storage bottles of the existing press-type soap dispensers are connected to a pump head in a threaded connection manner. When in installing, it is necessary to firstly screw the pump head and the liquid storage bottle before the liquid storage bottle is installed in a shell, and after cleaning liquid in the liquid storage bottle is used up, it is necessary to remove and unscrew the pump head and the liquid storage bottle before the cleaning liquid is added into the liquid storage bottle. The liquid storage bottle of the existing soap dispenser cannot be sealed at a bottle mouth after being taken down from the pump head, resulting in that residual cleaning liquid flows out, and the liquid storage bottle cannot be directly installed in an inverted soap dispenser shell when the cleaning liquid is added and the liquid storage bottle is installed, and the pump head is required to be taken down and installed on the liquid storage bottle, so that the liquid storage bottle may be installed on the soap dispenser shell after being sealed.

SUMMARY

In order to solve the problem of inconvenient use due to complex detaching and installing processes when cleaning liquid is added into an existing soap dispenser, the present disclosure provides a soap dispenser with a detachable liquid storage bottle.

The technical solution adopted by the present disclosure is as follows: A soap dispenser with a detachable liquid storage bottle includes a shell, a fixed seat, a pump head, and the liquid storage bottle, where both the liquid storage bottle and the pump head are installed inside the shell, one end of the liquid storage bottle is provided with an opening, the end, provided with the opening, of the liquid storage bottle faces the pump head, the pump head is disposed on the fixed seat, the pump head includes a liquid inlet pipe and a liquid outlet pipe, the liquid inlet pipe communicates with a cavity inside the liquid storage bottle, and the liquid outlet pipe has two ends, one end of the liquid outlet pipe being located inside the shell and the other end of the liquid outlet pipe being located outside the shell; and the soap dispenser further includes a lifting mechanism, the liquid storage bottle includes a positioning cover, the lifting mechanism is connected to the positioning cover in a repeatably detachable manner, the liquid storage bottle further includes a butting pipe, and the liquid inlet pipe communicates with the liquid storage bottle via the butting pipe, and communicates with the butting pipe in a repeatedly openable and closable manner.

Optionally, the lifting mechanism includes a pressing block, connecting rod, and a clamping seat, where the clamping seat is connected to the pressing block via the connecting rod, the pressing block is fixedly connected to the fixed seat, the clamping seat is located inside the fixed seat, the pressing block is movably connected to the clamping seat via the connecting rod, the connecting rod passes through the fixed seat, the positioning cover is installed on a bottleneck of the liquid storage bottle, and the positioning cover is located in an annular space enclosed by the connecting rod and the clamping seat;

the liquid storage bottle further includes a stop valve rod, the positioning cover is provided with a hole, the stop valve rod passes through one end of the hole in the positioning cover to be connected to the liquid inlet pipe, and the other end of the stop valve rod is located inside the liquid storage bottle;

the liquid storage bottle further includes a third elastic piece, the stop valve rod is connected to the butting pipe via the third elastic piece, and the stop valve rod is movable along an axial direction; and when the stop valve rod keeps away from the butting pipe, the liquid inlet pipe communicates with the butting pipe, and when the stop valve rod abuts against the butting pipe, the liquid inlet pipe does not communicate with the butting pipe.

Optionally, the fixed seat includes a second elastic piece, the second elastic piece is clamped on one side, far away from the liquid storage bottle, of a top surface of the clamping seat, and the lifting mechanism further includes a first elastic piece, one end of the first elastic piece abutting against the pressing block and the other end of the first elastic piece abutting against the fixed seat.

Optionally, a middle part of the top surface of the clamping seat is provided with an arc area, the second elastic piece is clamped on one side of the arc area, and a clamping bulge is disposed on the other side of the arc area; and the positioning cover is disposed on the bottleneck of the liquid storage bottle, the positioning cover is located in the arc area and abuts against the second elastic piece, and the clamping bulge is located between the positioning cover and a bottle body of the liquid storage bottle and abuts against the bottleneck.

Optionally, a clamping wall is disposed on one side, far away from the clamping bulge, of the arc area, and the second elastic piece is clamped on the clamping wall.

Optionally, the clamping seat includes a positioning groove, and one end, connected to the clamping seat, of the connecting rod is located in the positioning groove.

Optionally, a metal elastic sheet is installed at a bottom of the fixed seat, and the metal elastic sheet abuts against the second elastic piece.

Optionally, an installation groove is disposed at a bottom of the fixed seat, and the clamping seat is slidably installed in the installation groove.

Optionally, a groove wall, close to the clamping wall, on one side of the installation groove is provided with a second installation hole, and the second elastic piece passes through the second installation hole to be connected to the clamping wall.

Optionally, at least one of the second installation holes, at least one of the third elastic pieces and at least one of the metal elastic sheets are included.

Optionally, at least one of two sides of each of the second installation holes is provided with a reinforcing rib.

Optionally, the pump head includes a pressing rod, a pressing plate is hinged to and installed at one end of an upper shell of the shell, and the pressing plate is in contact with the pressing rod.

Optionally, positioning pins are disposed at a bottom of the fixed seat, a plurality of positioning ribbed plates are disposed at each of two sides of an inner cavity of a lower shell of the shell, gaps are provided between the positioning ribbed plates and a bottom wall of the lower shell, and the positioning pins are clamped in the gaps between the positioning ribbed plates and the lower shell.

Optionally, a limiting shade is concentrically disposed on one side, far away from the pump head, of the butting pipe, the stop valve rod is disposed between the butting pipe and the limiting shade, and the third elastic piece is disposed between the stop valve rod and the limiting shade; and a plurality of liquid inlet holes are formed in the limiting shade, and liquid in the liquid storage bottle enters the butting pipe via the liquid inlet holes.

Optionally, the stop valve rod includes a conical section and a straight rod section, and the outer diameter of a large end of the conical section is greater than the inner diameter of the butting pipe; and one end, far away from the conical section, of the straight rod section penetrates through the limiting shade, a third elastic piece sleeves the straight rod section, and the third elastic piece is located between the limiting shade and the conical section.

Optionally, the conical section further includes an overflow section disposed on an end surface of a small end of the conical section; and an overflow groove is formed in the overflow section, the outer diameter of the overflow section is equal to the inner diameter of the butting pipe and is located in the butting pipe, and when the liquid storage bottle is installed on the pump head, a pipe orifice of the liquid inlet pipe communicates with an inside of the liquid storage bottle via the overflow groove.

Optionally, the first elastic piece and/or the third elastic piece are spring devices.

Optionally, the fixed seat includes an installation hole, the metal elastic sheet is fixedly connected to a bottom of the installation hole, and the pump head is fixedly connected above the installation hole.

The present disclosure has the beneficial effects:

The present disclosure provides a soap dispenser with a detachable liquid storage bottle, including a shell, a fixed seat, a pump head, and the liquid storage bottle, where both the liquid storage bottle and the pump head are installed inside the shell, one end of the liquid storage bottle is provided with an opening, the end, provided with the opening, of the liquid storage bottle faces the pump head, the pump head is disposed on the fixed seat, the pump head includes a liquid inlet pipe and a liquid outlet pipe, the liquid inlet pipe communicates with a cavity inside the liquid storage bottle, and the liquid outlet pipe has two ends, one end of the liquid outlet pipe being located inside the shell and the other end of the liquid outlet pipe being located outside the shell; and the soap dispenser further includes a lifting mechanism, the liquid storage bottle includes a positioning cover, the lifting mechanism is connected to the positioning cover in a repeatably detachable manner, the liquid storage bottle further includes a butting pipe, and the liquid inlet pipe communicates with the liquid storage bottle via the butting pipe, and communicates with the butting pipe in a repeatably openable and closable manner. When the cleaning liquid is added, the liquid storage bottle may be taken down only by pressing down the pressing block, and after the cleaning liquid is added, the liquid storage bottle is only required to be aligned with the pump head and the second elastic piece is pushed to be separated from the clamping seat, and then the first elastic piece drives the pressing block and the clamping seat to automatically rebound and lock the liquid storage bottle. When in detaching, the liquid storage bottle may be automatically ejected only by pressing a pressing block with one hand, and when the liquid storage bottle is installed, the clamping seat may be automatically ejected only by pressing the liquid storage bottle with one hand to lock the liquid storage bottle, which is simple in detaching and installing, and is very convenient in use.

Figure 1:
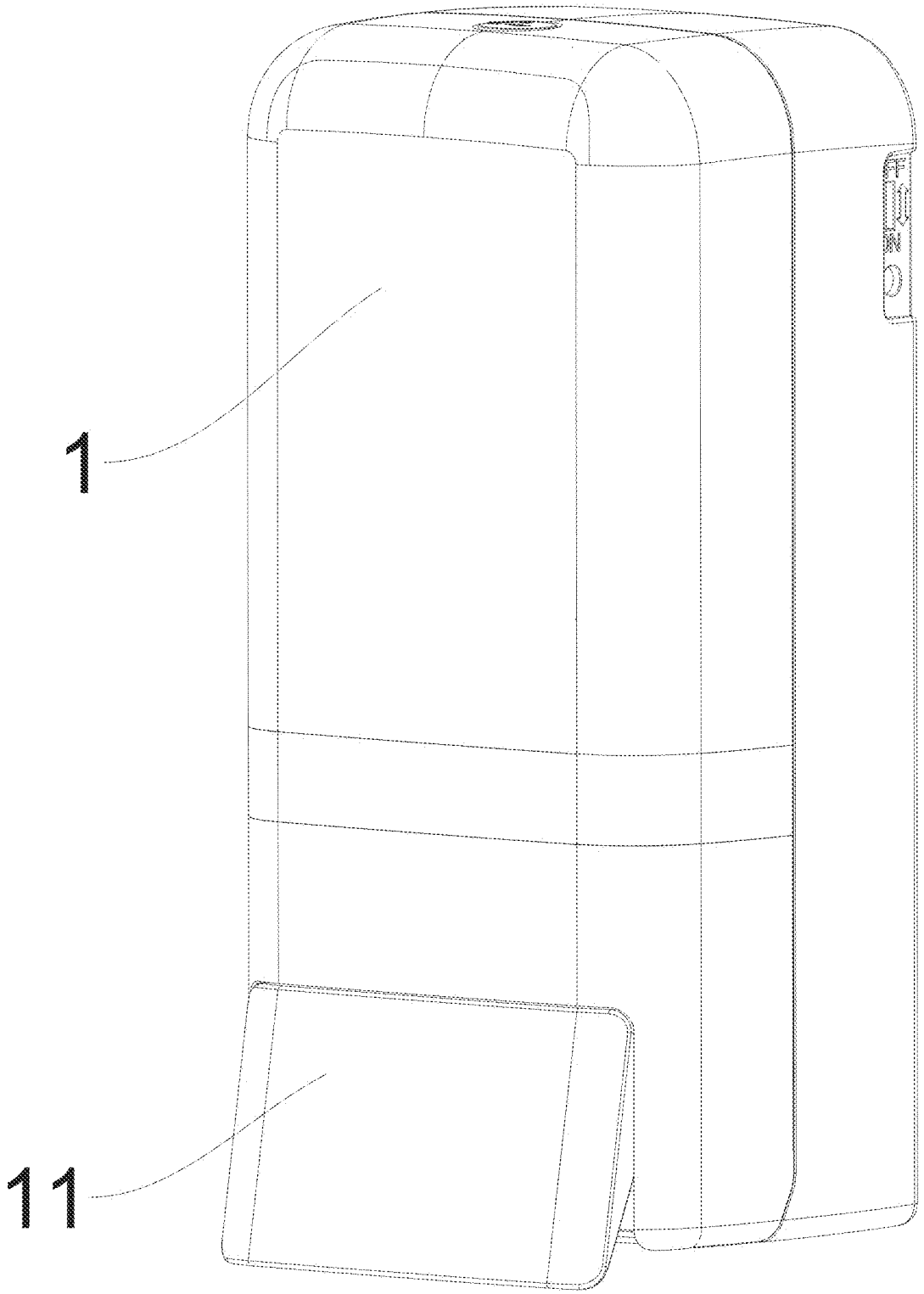
FIG. 1 is a schematic diagram of an overall structure of a soap dispenser.
Figure 2:
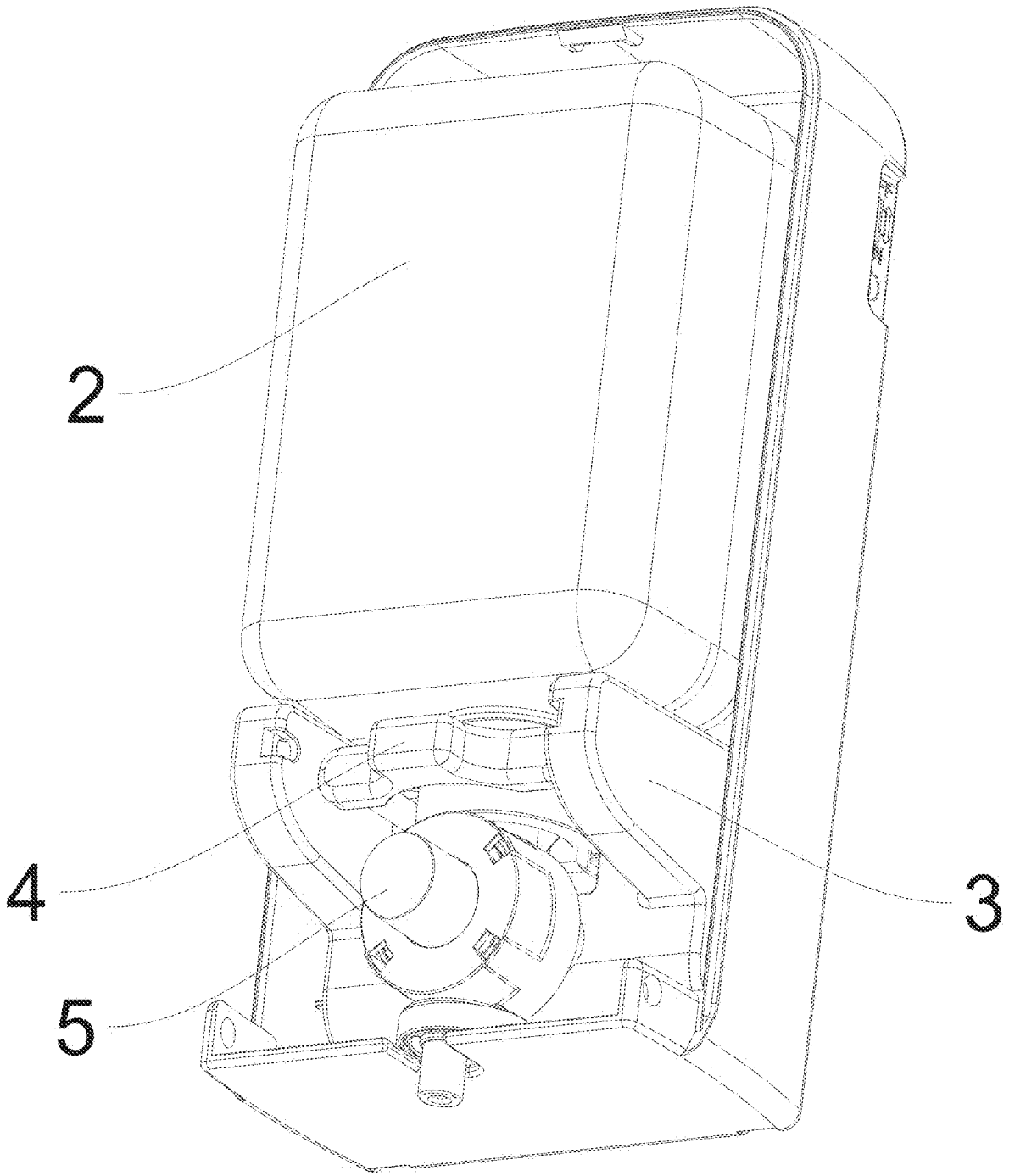
FIG. 2 is a schematic structural diagram of the soap dispenser without an upper shell.
Figure 3:
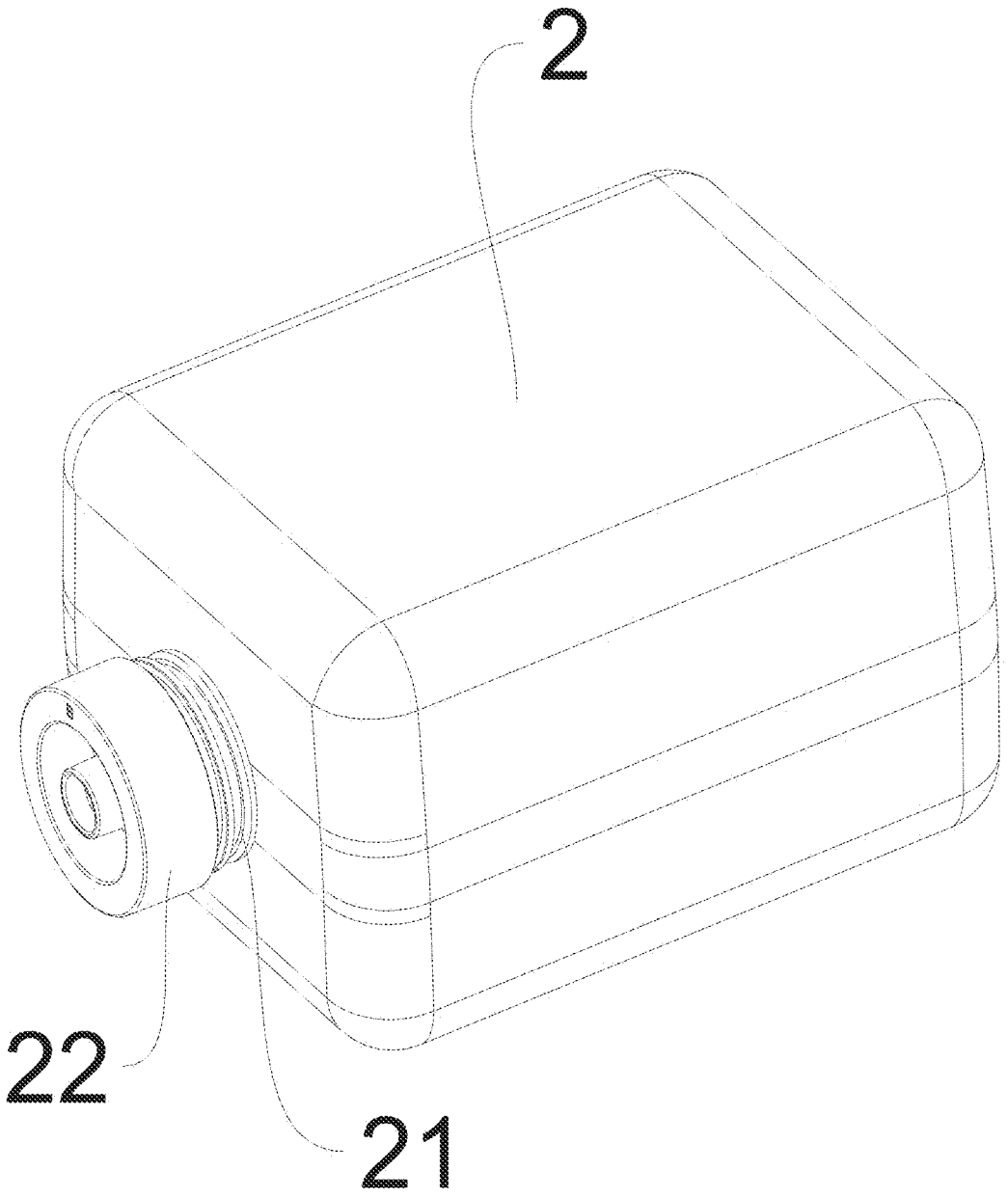
FIG. 3 is a schematic structural diagram of a liquid storage bottle.

Reference numerals: 1—shell, 11—pressing plate, 12—lower shell, 13—positioning ribbed plate, 2—liquid storage bottle, 21—bottleneck, 22—positioning cover, 221—butting pipe, 25—limiting shade, 251—notch, 252—limiting cap, 26—stop valve rod, 261—conical section, 262—straight rod section, 2611—overflow hole, 27—third elastic piece, 28—filling port, 29—air pressure valve, 291—valve cap, 292—air pressure valve rod, 293—airflow groove, 3—fixed seat, 31—installation groove, 33—second elastic piece, 311—first installation hole, 312—reinforcing rib, 34—installation hole, 35—through hole, 36—positioning pin, 37—metal elastic sheet, 4—lifting mechanism, 41—pressing block, 42—connecting rod, 43—clamping seat, 431—positioning groove, 44—arc area, 45—clamping bulge, 46—clamping wall, 5—pump head, 51—liquid inlet pipe, 52—liquid outlet pipe, 53—pressing rod.

DETAILED DESCRIPTION OF THE INVENTION

In the present embodiment, as shown in FIGS. 1 to 14, a soap dispenser with a detachable liquid storage bottle includes a shell 1, a fixed seat 3, a pump head 5, and the liquid storage bottle 2, where both the liquid storage bottle 2 and the pump head 5 are installed inside the shell 1, one end of the liquid storage bottle 2 is provided with an opening, the end, provided with the opening, of the liquid storage bottle 2 faces the pump head 5, the pump head 5 is disposed on the fixed seat 3, the pump head 5 includes a liquid inlet pipe 51 and a liquid outlet pipe 52, the liquid inlet pipe 51 communicates with a cavity inside the liquid storage bottle 2, and the liquid outlet pipe 52 has two ends, one end of the liquid outlet pipe 52 being located inside the shell 1 and the other end of the liquid outlet pipe 52 being located outside the shell 1; and the soap dispenser further includes a lifting mechanism 4, the liquid storage bottle 2 includes a positioning cover 22, the lifting mechanism 4 is connected to the positioning cover 22 in a repeatably detachable manner, the liquid storage bottle 2 further includes a butting pipe 221, the liquid inlet pipe 51 communicates with the liquid storage bottle 2 via the butting pipe 221, and the liquid inlet pipe 51 communicates with the butting pipe 221 in a repeatably openable and closable manner.

The lifting mechanism 4 includes a pressing block 41, a connecting rod 42, and a clamping seat 43, where the clamping seat 43 is connected to the pressing block 41 via the connecting rod 42, the pressing block 41 is fixedly connected to the fixed seat 3, the clamping seat 43 is located inside the fixed seat 3, the pressing block 41 is movably connected to the clamping seat 43 via the connecting rod 42, the connecting rod 42 passes through the fixed seat 3, the positioning cover 22 is installed on a bottleneck 21 of the liquid storage bottle 2, and the positioning cover 22 is located in an annular space enclosed by the connecting rod 42 and the clamping seat 43;

the liquid storage bottle 2 further includes a stop valve rod 26, the positioning cover 22 is provided with a hole, the stop valve rod 26 passes through one end of the hole in the positioning cover 22 to be connected to the liquid inlet pipe 51, and the other end of the stop valve rod is located inside the liquid storage bottle 2; and the liquid storage bottle 2 further includes a third elastic piece 27, the stop valve rod 26 is connected to the butting pipe 221 via the third elastic piece 27, and the stop valve rod 26 is movable along an axial direction; and when the stop valve rod 26 keeps away from the butting pipe 221, the liquid inlet pipe 51 communicates with the butting pipe 221, and when the stop valve rod 26 abuts against the butting pipe 221, the liquid inlet pipe 51 does not communicate with the butting pipe 221.

When the stop valve rod 26 keeps away from the butting pipe 221, the liquid inlet pipe 51 communicates with the butting pipe 221, and when the stop valve rod 26 abuts against the butting pipe 221, the liquid inlet pipe 51 does not communicate with the butting pipe 221. And the liquid storage bottle 2 is separated from the pump head 5, the stop valve rod 26 abuts against and seals the butting pipe 221 via the third elastic piece 27; and when the liquid storage bottle 2 is connected together with the pump head 5, the liquid inlet pipe 51 pushes the stop valve rod 26 to keep away from the butting pipe 221, and the liquid inlet pipe 51 is enabled to communicate with an inner cavity of the liquid storage bottle 2 via the butting pipe 221. When the liquid storage bottle 2 is taken down and cleaning liquid is added, after the liquid storage bottle 2 is separated from the pump head 5, the stop valve rod 26 abuts against and seals the butting pipe 221 via the third elastic piece 27, so that the inner cavity of the liquid storage bottle 2 is isolated from the outside, and the residual liquid in the liquid storage bottle 2 cannot flow out, and the liquid storage bottle 2 may be directly installed in the shell 1 in an inverted manner after the cleaning liquid is added, without the need to worry about the problem that the cleaning liquid is poured out, which is more convenient and quicker in use.

Figure 11:
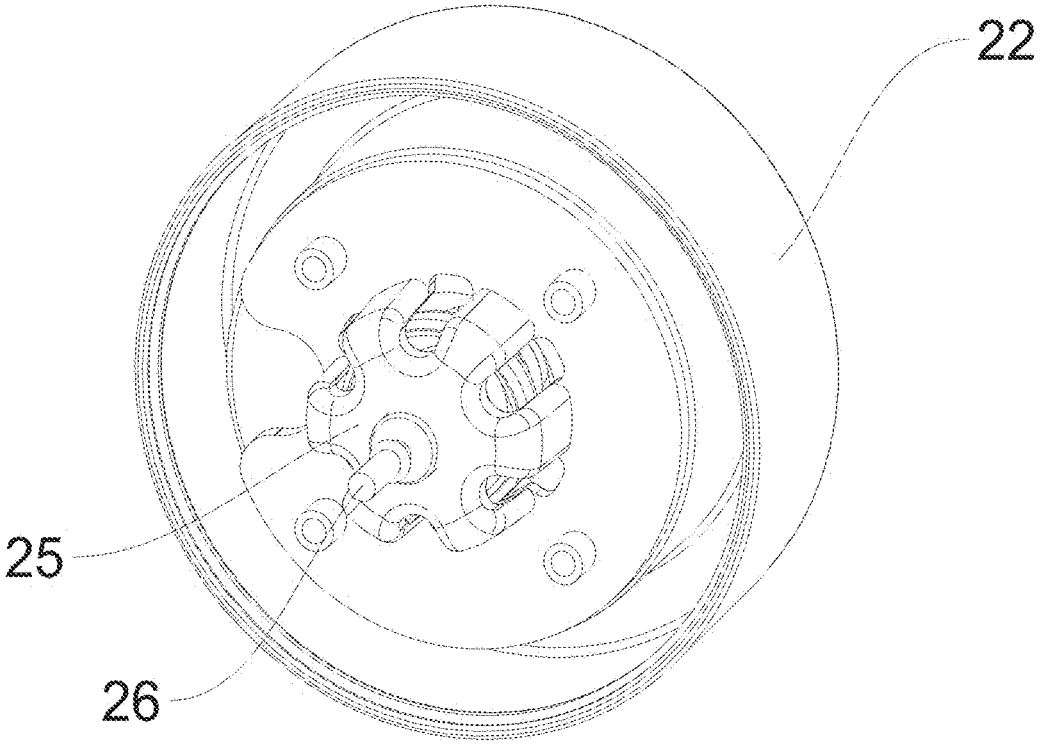
FIG. 11 is a schematic structural diagram of the positioning cover from another view.
Figure 12:
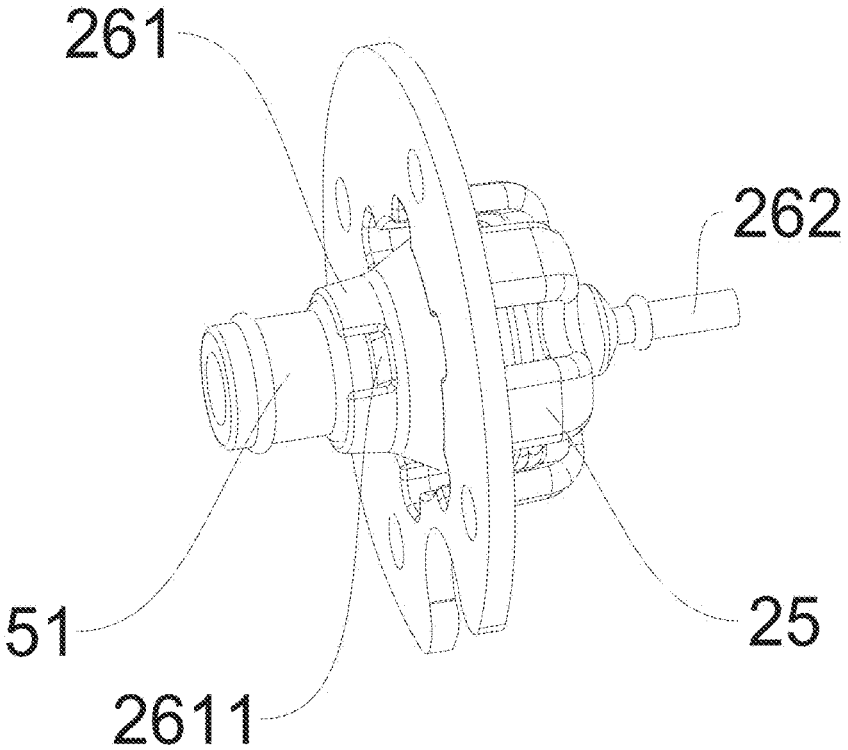
FIG. 12 is a schematic diagram of a positional relationship among a limiting shade, a liquid inlet pipe, and a stop valve rod.
Figure 13:
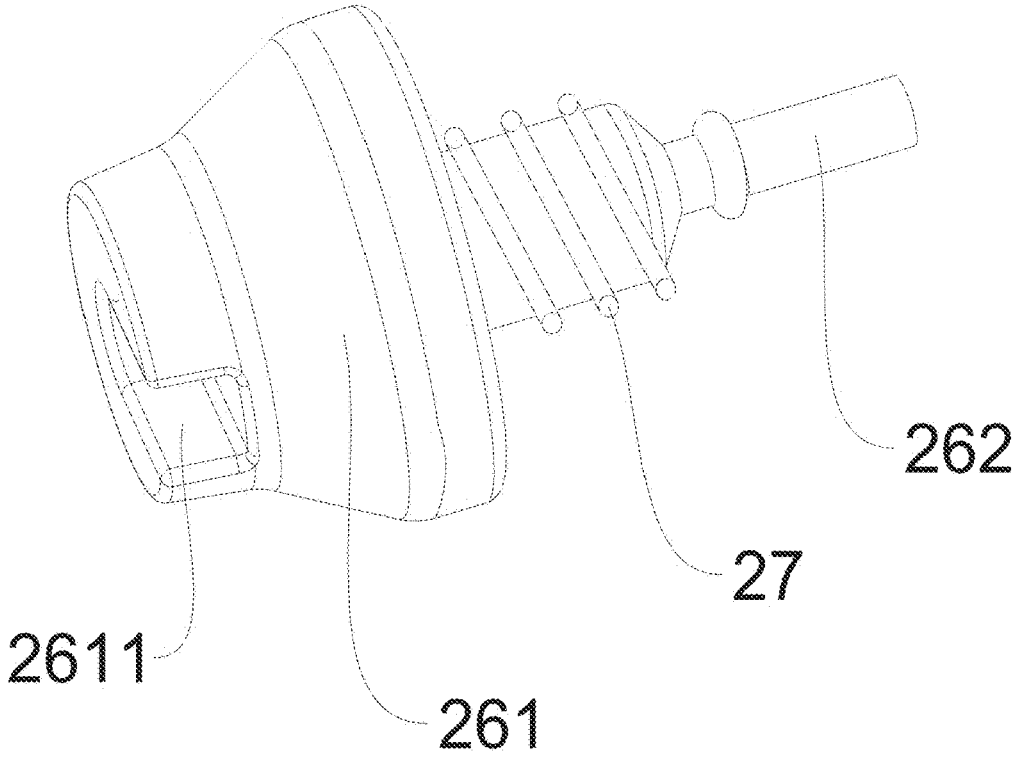
FIG. 13 is a schematic structural diagram of the stop valve rod.

In the present embodiment, as shown in FIGS. 11 and 12, a limiting shade 25 is concentrically disposed on one side, far away from the pump head 5, of the butting pipe 221, the stop valve rod 26 is disposed between the butting pipe 221 and the limiting shade 25, and the third elastic piece 27 is disposed between the stop valve rod 26 and the limiting shade 25; and a plurality of liquid inlet holes are formed in the limiting shade 25, and liquid in the liquid storage bottle 2 enters the butting pipe 221 via the liquid inlet holes. The stop valve rod 26 includes a conical section 261, an overflow section, and a straight rod section 262, the outer diameter of a large end of the conical section 261 is greater than the inner diameter of the butting pipe 221, one end, far away from the conical section 261, of the straight rod section 262 penetrates through the limiting shade 25, a third elastic piece 27 sleeves the straight rod section 262, and the third elastic piece 27 is located between the limiting shade 25 and the conical section 261. The overflow section disposed on an end surface of a small end of the conical section 261; and an overflow groove 2611 is formed in the overflow section, the outer diameter of the overflow section is equal to the inner diameter of the butting pipe 221 and is located in the butting pipe 221, and when the liquid storage bottle 2 is installed on the pump head 5, a pipe orifice of the liquid inlet pipe 51 communicates with an inside of the liquid storage bottle 2 via the overflow groove 2611.

In the present embodiment, the butting pipe 221 and the bottleneck 21 are concentrically disposed, a seal ring sleeves the liquid inlet pipe 51, the outer diameter of the liquid inlet pipe 51 is slightly less than the inner diameter of the butting pipe 221, and after the liquid inlet pipe 51 enters the butting pipe 221, the seal ring seals a gap between the outer wall of the liquid inlet pipe 51 and the inner wall of the butting pipe 221, so that the cleaning liquid can only be outputted from the liquid inlet pipe 51 after passing through the liquid inlet pipe 51 and the overflow groove in sequence.

When the liquid storage bottle 2 is installed, the liquid inlet pipe 51 is aligned with the butting pipe 221, then the liquid inlet pipe 51 is pushed into the butting pipe 221, and the liquid inlet pipe 51 is enabled to push the conical section 261 of the stop valve rod 26 to keep away from the butting pipe, so that the butting pipe 221 is no longer isolated from the inner cavity of the liquid storage bottle 2; and when the liquid storage bottle 2 is installed in place, the overflow groove 2611 communicates the liquid inlet pipe 51 with the inner cavity of the liquid storage bottle 2.

When the liquid storage bottle is taken down, as the liquid inlet pipe 51 is gradually pulled away from the butting pipe 221, the stop valve rod 26 rebounds to the butting pipe 221 under the action of the third elastic piece 27, and the overflow section is completely pushed into the butting pipe 221, so that the conical section 261 blocks the butting pipe 221, and the butting pipe 221 is isolated from the inner cavity of the liquid storage bottle 2.

In the present embodiment, the third elastic piece 27 is a spring sleeving the straight rod section 262, and two ends of the third elastic piece 27 respectively abut against the conical section 261 and the limiting shade 25.

Figure 14:
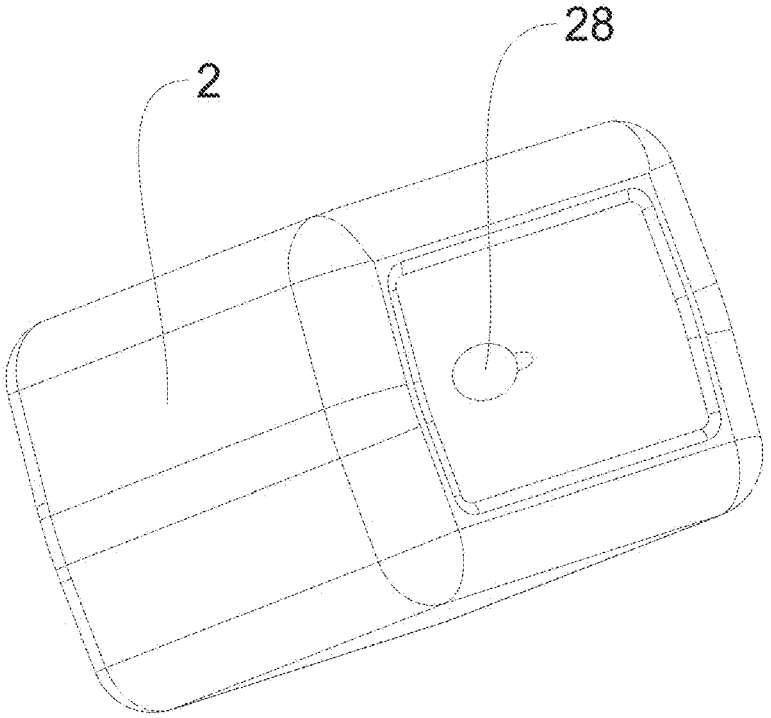
FIG. 14 is a schematic structural diagram of the liquid storage bottle from another view.
Figure 15:
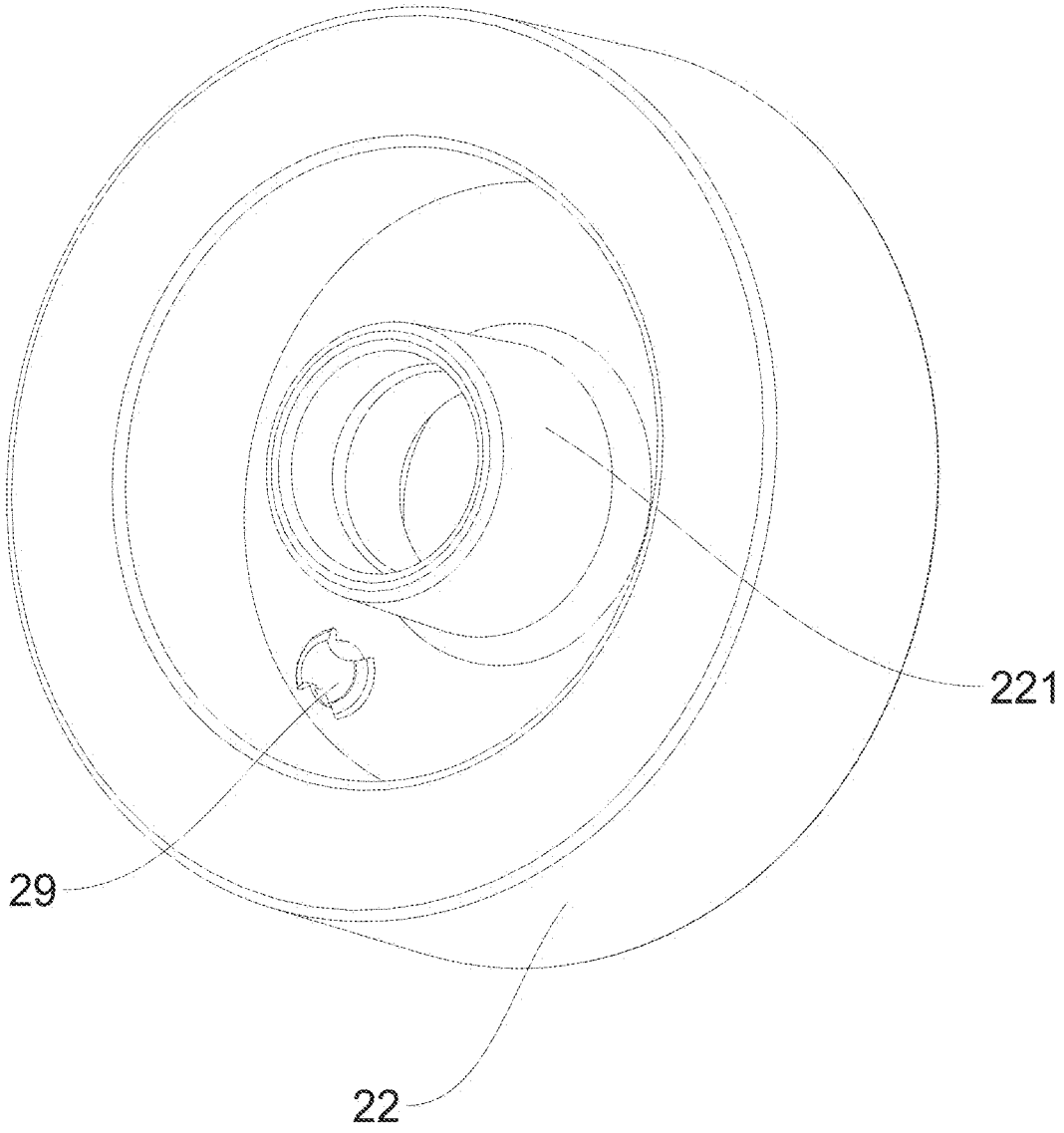
FIG. 15 and FIG. 16 are schematic structural diagrams of the positioning cover with an air pressure valve mounted thereon.
Figure 16:
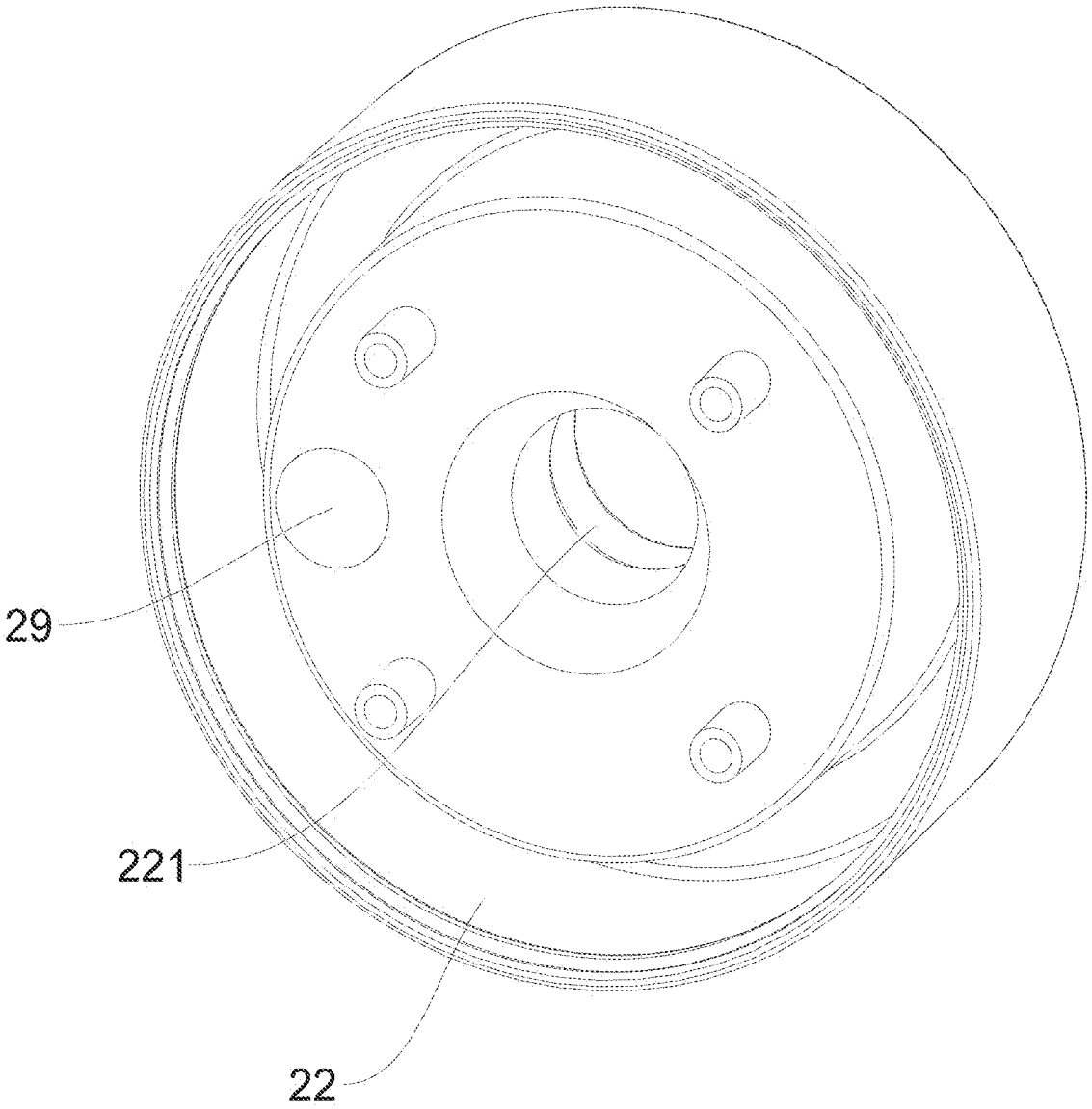
Figure 17:
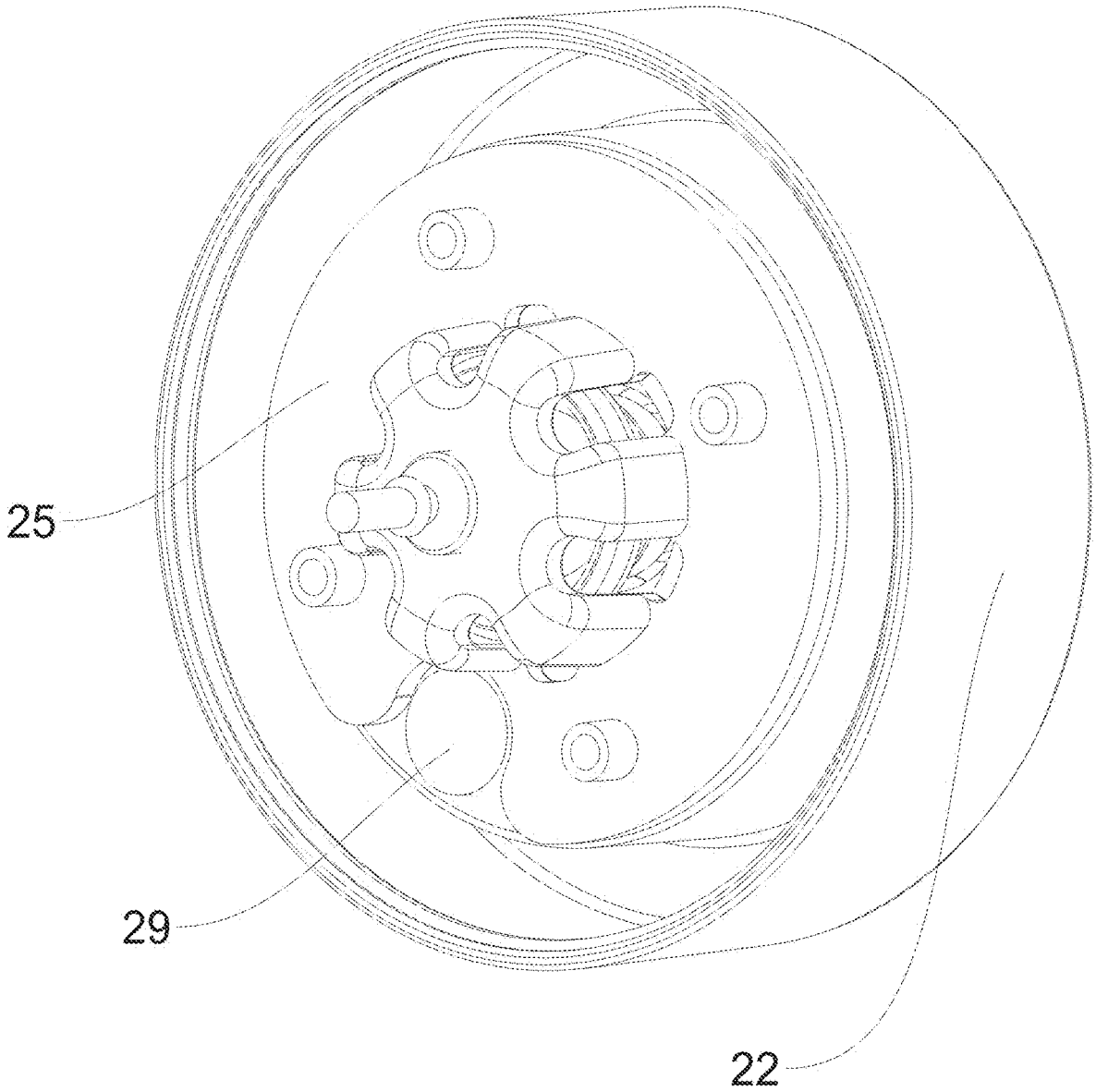
FIG. 17 is a schematic diagram of positions of the air pressure valve and the limiting shade on the positioning cover.
Figure 18:
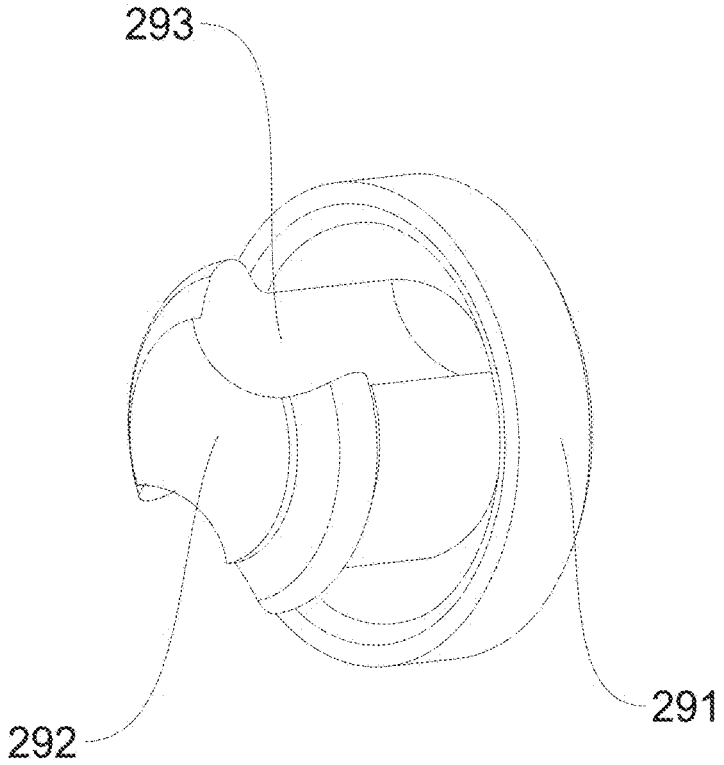
FIG. 18 is a schematic structural diagram of the air pressure valve.
Figure 19:
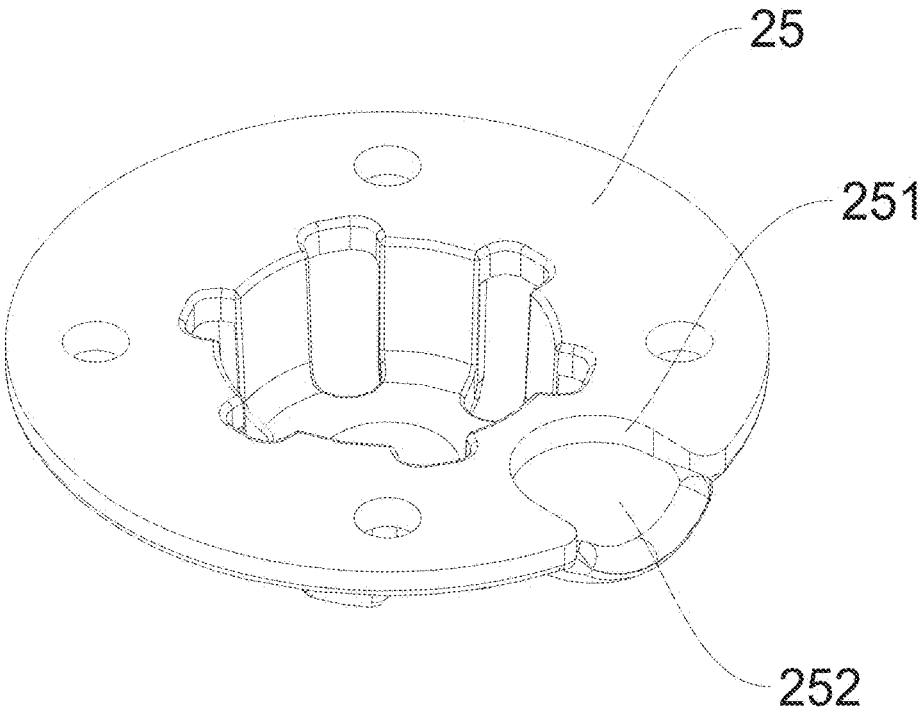
FIG. 19 and FIG. 20 are schematic structural diagrams of the limiting shade in Embodiment 6.
Figure 20:
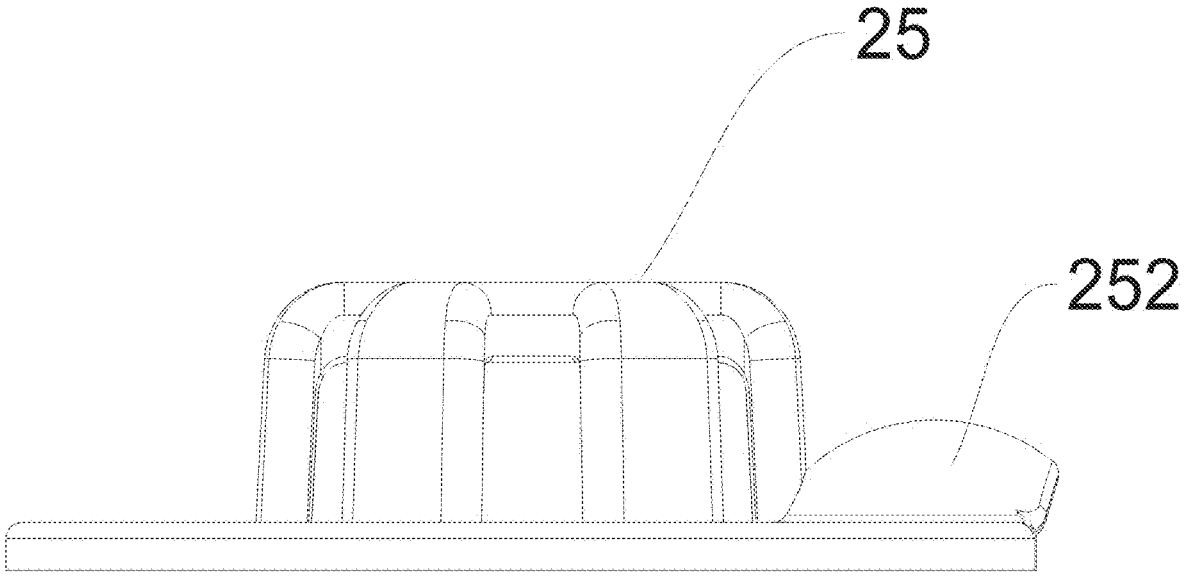

In the present embodiment, as shown in FIG. 14, one end, far away from the pump head 5, of the liquid storage bottle 2 is provided with a filling port 28. When the cleaning liquid is filled, the filling is performed via the filling port 28, the filling port 28 is equipped with a corresponding sealing cover, and the filling port 28 is covered after the filling is completed.

In other embodiments, the filling port 28 may not be provided, the liquid storage bottle 28 is filled with the cleaning liquid via a pipeline, and communicates with the butting pipe 221 via the pipeline, and the filling may be realized by pushing the stop valve rod 26 to communicate with the inner cavity of the liquid storage bottle 2.

In other embodiments, the liquid storage bottle 2 is a disposable container, a standby liquid storage bottle 2 is filled with the cleaning liquid, and a stop valve at the bottle mouth of the liquid storage bottle 2 enables the liquid storage bottle 2 to be sealed for long-term storage. After the cleaning liquid in the liquid storage bottle 2 connected to the pump head 5 is used up, the standby liquid storage bottle 2 is directly used for replacement.

In other embodiments, the stop valve rod 26 is not provided with the third elastic piece 27, by setting the straight rod section 262 of the stop valve rod 26 as a reducing rod, a small end of the reducing rod penetrates through the limiting shade 25, a large end of the reducing rod is located between the conical section 261 and the limiting shade 25, the large end of the reducing rod is made of a silicone material, and the silicone material has elasticity. When an end surface, abutting against the conical section 261, of the liquid inlet pipe 51 pushes the stop valve rod 26 to move, the large end of the reducing rod is compressed and elastically deformed, and after the liquid storage bottle 2 is taken down, the silicone material automatically rebounds to seal the liquid storage bottle 2.

Embodiment 2

On the basis of the Embodiment 1, the present embodiment provides a quick detaching and installing structure for the liquid storage bottle and the pump head.

In the present embodiment, as shown in FIGS. 1 to 9, a soap dispenser with a detachable liquid storage bottle includes a shell 1, a pump head 5, a fixed seat 3, a lifting mechanism 4, and the liquid storage bottle 2, where the liquid storage bottle 2 is installed at one end of the inside of the shell 1, the pump head 5 is installed at the other end of the shell 1, the pump head 5 is installed on the fixed seat 3, and a liquid inlet pipe 51 of the pump head 5 is connected to the liquid storage bottle 2 and a liquid outlet pipe 52 of the pump head 5 penetrates through the shell 1; the lifting mechanism 4 includes a pressing block 41, a connecting rod 42, and a clamping seat 43, where the clamping seat 43 is connected to the pressing block 41 via the connecting rod 42; the clamping seat 43 is installed at a bottom of the fixed seat 3 in a sliding manner, the connecting rod 42 penetrates through the fixed seat 3, and first elastic pieces 421 are disposed on the pressing block 41 and a top surface of the fixed seat 3; and a second elastic piece 33 is installed on the fixed seat 3, and the second elastic piece 33 is clamped on one side, far away from the liquid storage bottle 2, of a top surface of the clamping seat 43. When the soap dispenser is normally used, the liquid storage bottle 2 pushes the second elastic piece 33 to be separated from the clamping seat 43, after the clamping seat 43 is not limited by the second elastic piece 33, the first elastic piece 421 pushes the pressing block 41 to ascend to drive the clamping seat 43 to abut against the liquid storage bottle 2. When the cleaning liquid is required to be replaced, the pressing block 41 is pressed down, the clamping seat 43 moves downward to be separated from the liquid storage bottle 2, so that the liquid storage bottle 2 is no longer clamped, at this time, the liquid storage bottle 2 may be directly pulled away from the pump head 5. After the liquid storage bottle 2 is pulled away, the second elastic piece 33 automatically rebounds under the action of the elastic force, and is clamped on the clamping seat 43. At this time, the clamping seat 43 sinks below a top wall of the fixed seat 3, and does not block the liquid storage bottle 2. After the cleaning liquid is added into the liquid storage bottle 2 and the liquid storage bottle 2 is in butt joint with the pump head 4, the liquid storage bottle 2 pushes the second elastic piece 33 to keep away from the clamping seat 43, so that the clamping seat 43 moves upward under the action of the first elastic piece 421 and clamps the liquid storage bottle 2 to complete the fixation of the liquid storage bottle 2. In the present disclosure, when the cleaning liquid is added, the liquid storage bottle 2 may be taken down only by pressing down the pressing block 41, and after the cleaning liquid is added, the liquid storage bottle 2 is only required to be aligned with the pump head 5 and the second elastic piece 33 is pushed to be separated from the clamping seat 43, and then the first elastic piece 421 drives the pressing block 41 and the clamping seat 43 to automatically rebound and lock the liquid storage bottle 2, which is simple in detaching and installing, and is very convenient in use.

The clamping seat 43 includes a positioning groove 431, and one end, connected to the clamping seat 43, of the connecting rod 42 is located in the positioning groove 431. The positioning groove 431 may reduce the displacement or falling of the connecting rod 42.

Embodiment 3

On the basis of any of the above embodiments, the present embodiment provides an optional solution for a specific structure of the lifting mechanism.

In the present embodiment, as shown in FIGS. 4 to 8, a middle part of the top surface of the clamping seat 43 is provided with an arc area 44, the second elastic piece 33 is clamped on one side of the arc area 44, and the other side of the arc area 44 is provided with a clamping bulge 45; and a positioning cover 22 is disposed on a bottleneck 21 of the liquid storage bottle 2.

During normal use, the positioning cover 22 is located in the arc area 44 and abuts against the second elastic piece 33, and the clamping bulge 45 is located between the positioning cover 22 and the bottle body of the liquid storage bottle 2 and abuts against the bottleneck 21. At this time, the positioning cover 22 of the liquid storage bottle 2 is located in the arc area 44, and the center of the positioning cover 22 communicates with the inside of the liquid storage bottle 2. After the positioning cover 22 pushes the second elastic piece 33 to be separated from the clamping seat 43, the liquid outlet pipe 53 is also clamped into the bottleneck 21, thereby communicating with the inner cavity of the liquid storage bottle 2.

When the liquid storage bottle 2 is detached, the pressing block 41 is pressed down, the clamping bulge 45 moves to the bottom of the fixed seat 3 until the clamping bulge 45 sinks below the top surface of the fixed seat 3, and at this time, the clamping bulge 45 does not clamp the bottleneck 21; and the liquid storage bottle 2 may be taken down by pulling the liquid storage bottle 2 away from one end of the pump head 5, and after the liquid storage bottle 2 is pulled away, the second elastic piece 33 automatically rebounds and is clamped on the clamping seat 43, so that the first elastic piece 421 cannot rebound. Therefore, when the liquid storage bottle 2 is reinstalled, the second elastic piece 33 may be separated from the clamping seat 43 by directly aligning the center of the positioning cover 22 with the liquid inlet pipe 51 and then pushing the positioning cover toward the pump head 5, and the first elastic piece 421 automatically rebounds and drives the clamping seat 43 to clamp the bottleneck 21.

In the present embodiment, the pump head 5 includes a pressing rod 53, a pressing plate 11 is hinged to and installed at one end of an upper shell of the shell 1, and the pressing plate 11 is in contact with the pressing rod 53. When the cleaning liquid is required to be used, the pressing rod 53 is synchronously pushed to move by pressing down the pressing plate 11, so that the liquid inlet pipe 51 and the liquid outlet pipe 52 are communicated, and the cleaning liquid in the liquid storage bottle 2 may flow out from the liquid outlet pipe 52. The pump head mentioned in the present application may refer to the pump head disclosed in the invention patent with the patent number of ZL202320678895.9, and the structure and principle thereof are not described here.

Figure 4:
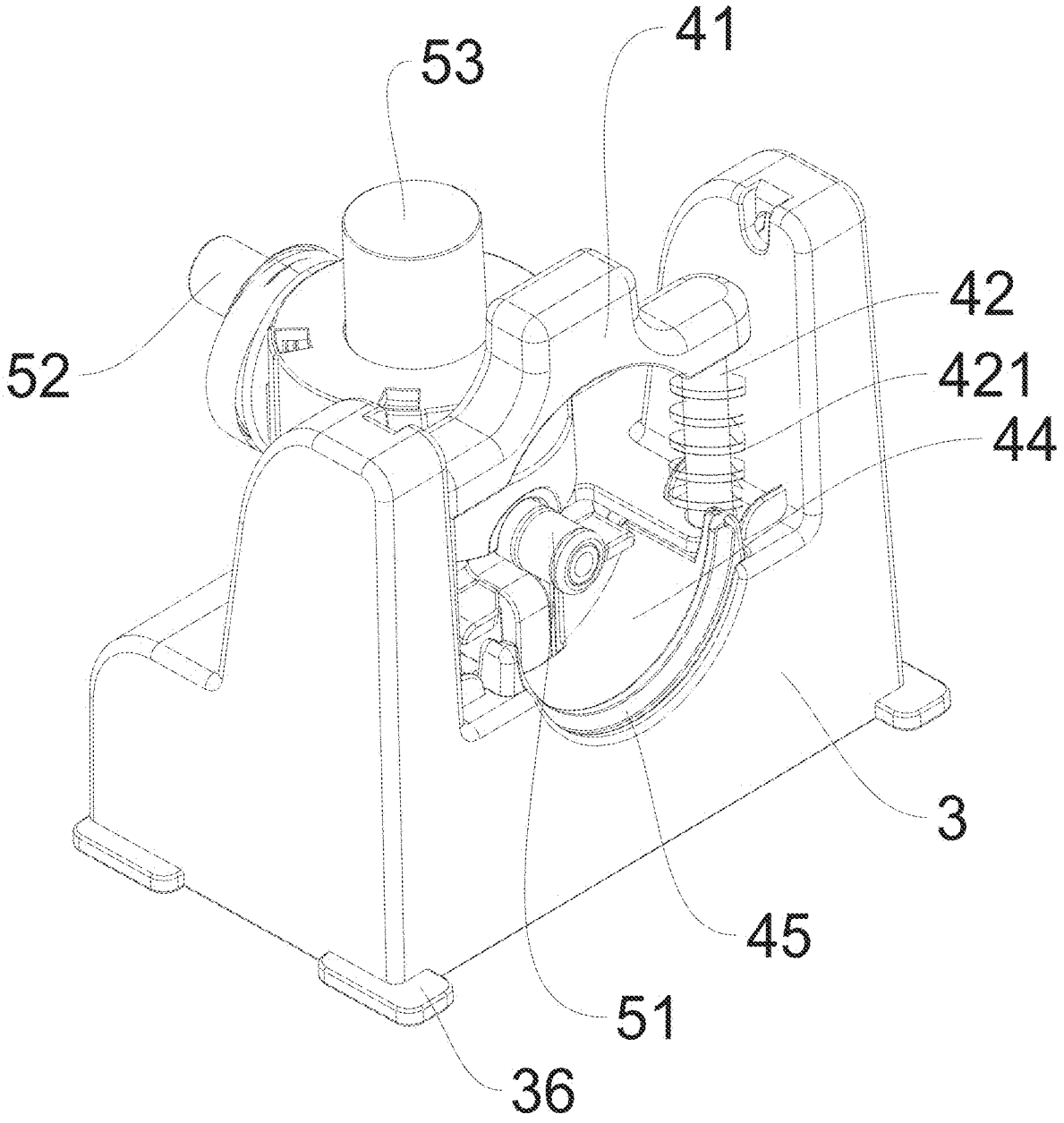
FIG. 4 is a schematic diagram of an installation structure of a pump head, a fixed seat and a lifting mechanism.
Figure 8:
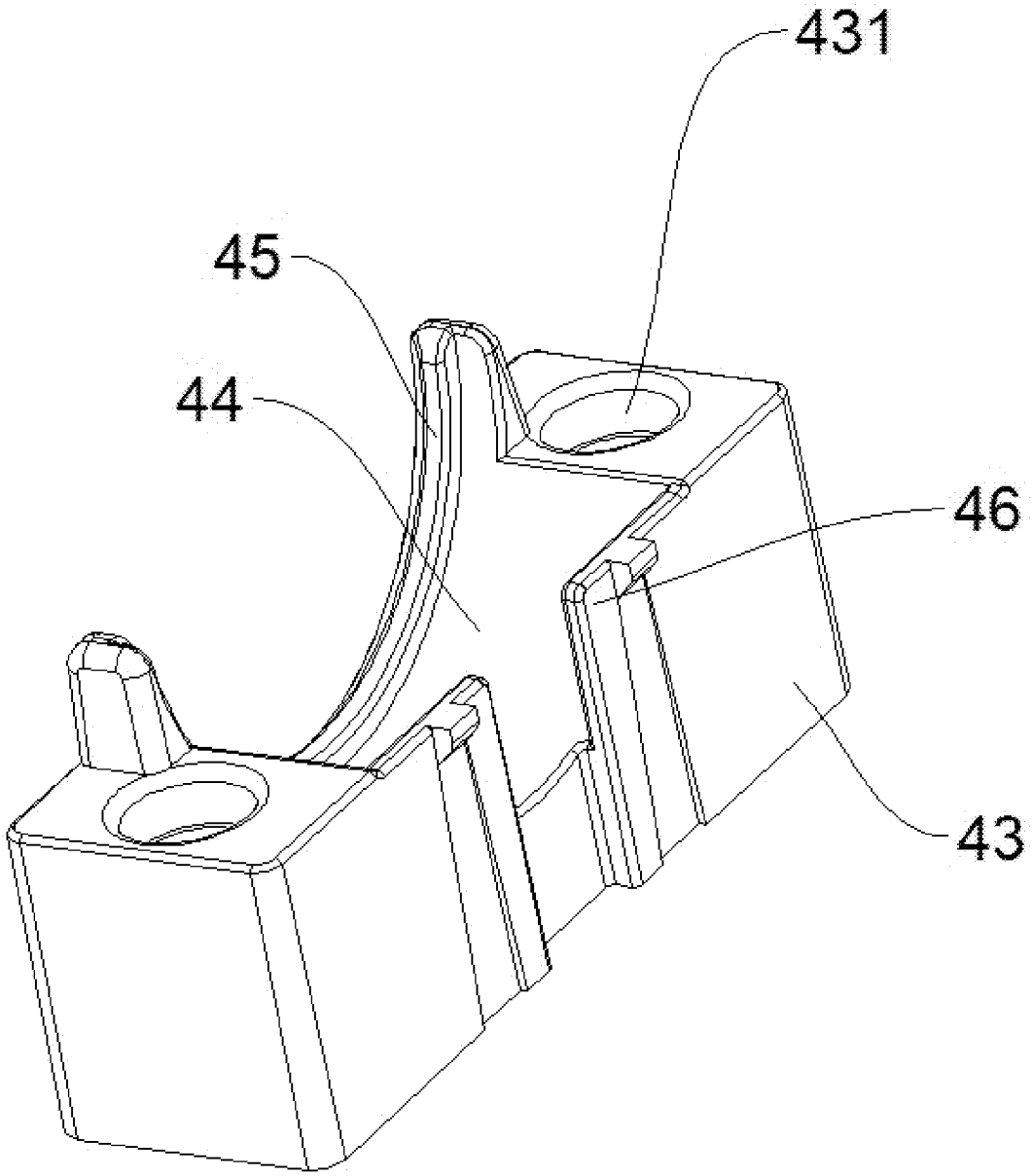
FIG. 8 is a schematic structural diagram of a clamping seat.
Figure 9:
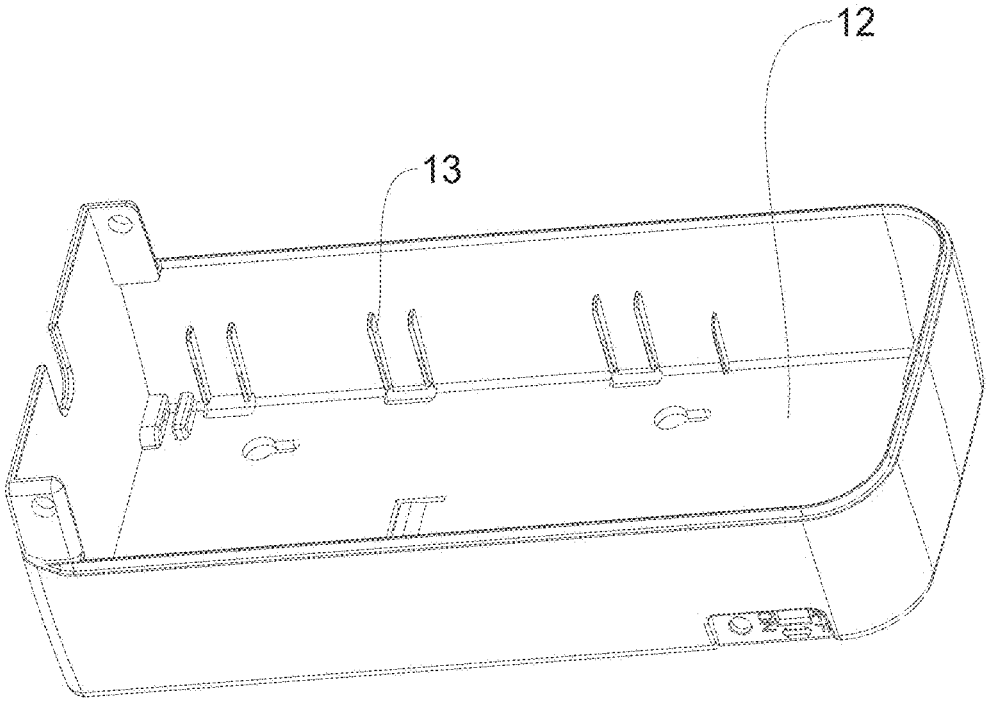
FIG. 9 is a schematic structural diagram of a lower shell.
Figure 10:
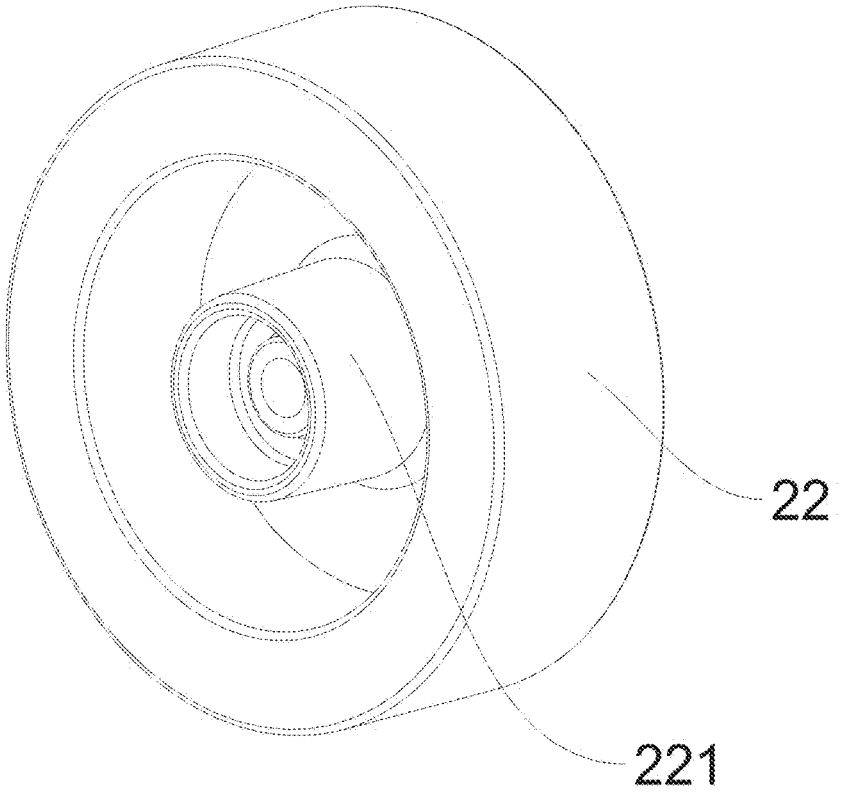
FIG. 10 is a schematic structural diagram of a positioning cover.

In the present embodiment, as shown in FIG. 4 and FIG. 8, a clamping wall 46 is disposed on one side, far away from the clamping bulge 45, of the arc area 44, and the second elastic piece 33 is clamped on the clamping wall 46.

Embodiment 4

On the basis of any of the above embodiments, the present embodiment provides an optional solution for a specific structure of the fixed seat.

In the present embodiment, as shown in FIGS. 3 to 6, an installation groove 31 is disposed at the bottom of the fixed seat 3, and the clamping seat 43 is slidably installed in the installation groove 31. Through holes 35 are formed in two sides of the top wall of the fixed seat 3, and the connecting rod 42 passes through the through holes 35 to connect the clamping seat 43 and the pressing block 41 together. The first elastic piece 421 is disposed between the pressing block 41 and a top wall of the fixed seat 3.

In the present embodiment, the first elastic piece 421 is a spring which sleeves the connecting rod 42.

Figure 5:
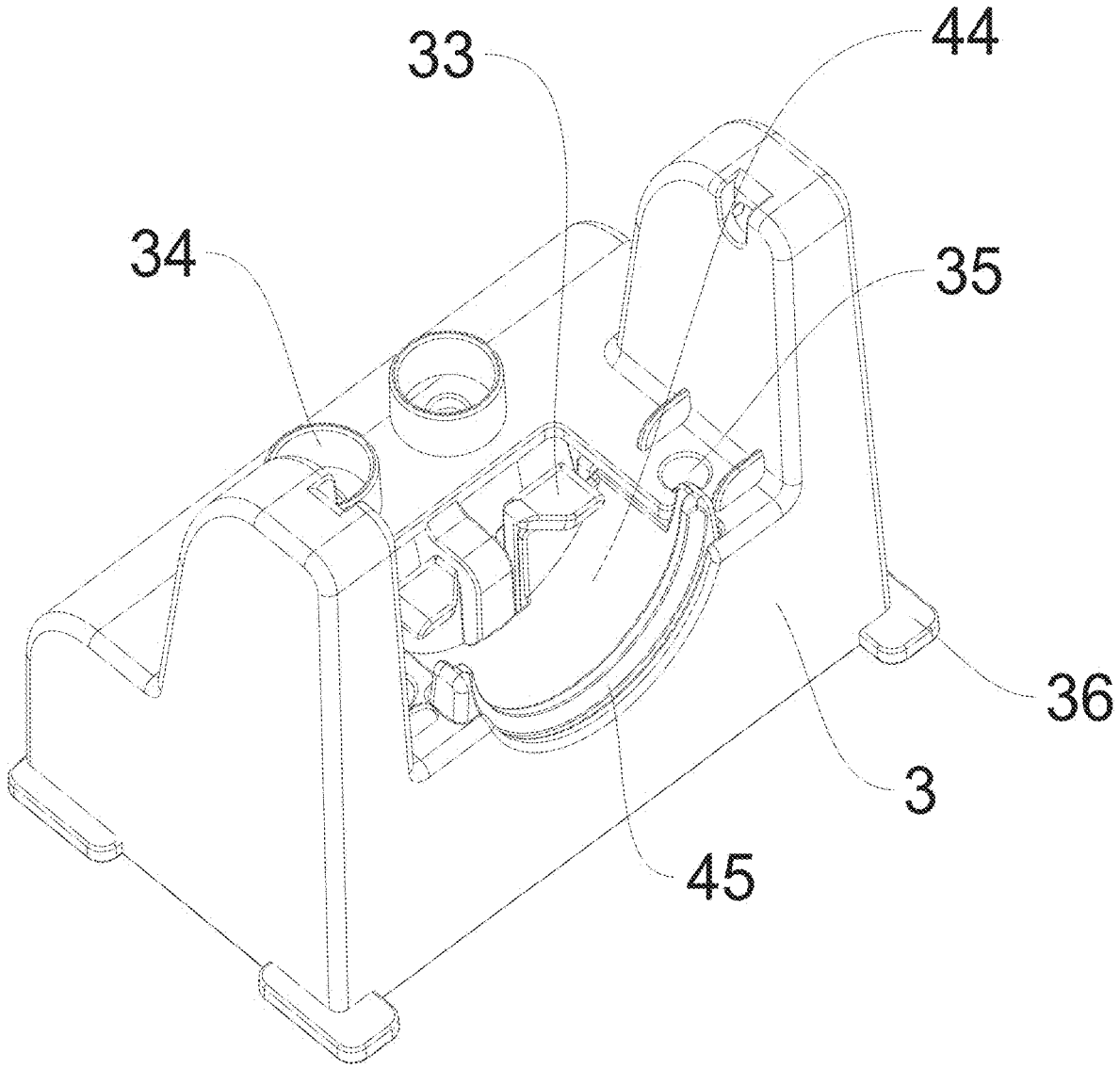
FIG. 5 is a schematic structural diagram of the fixed seat.
Figure 6:
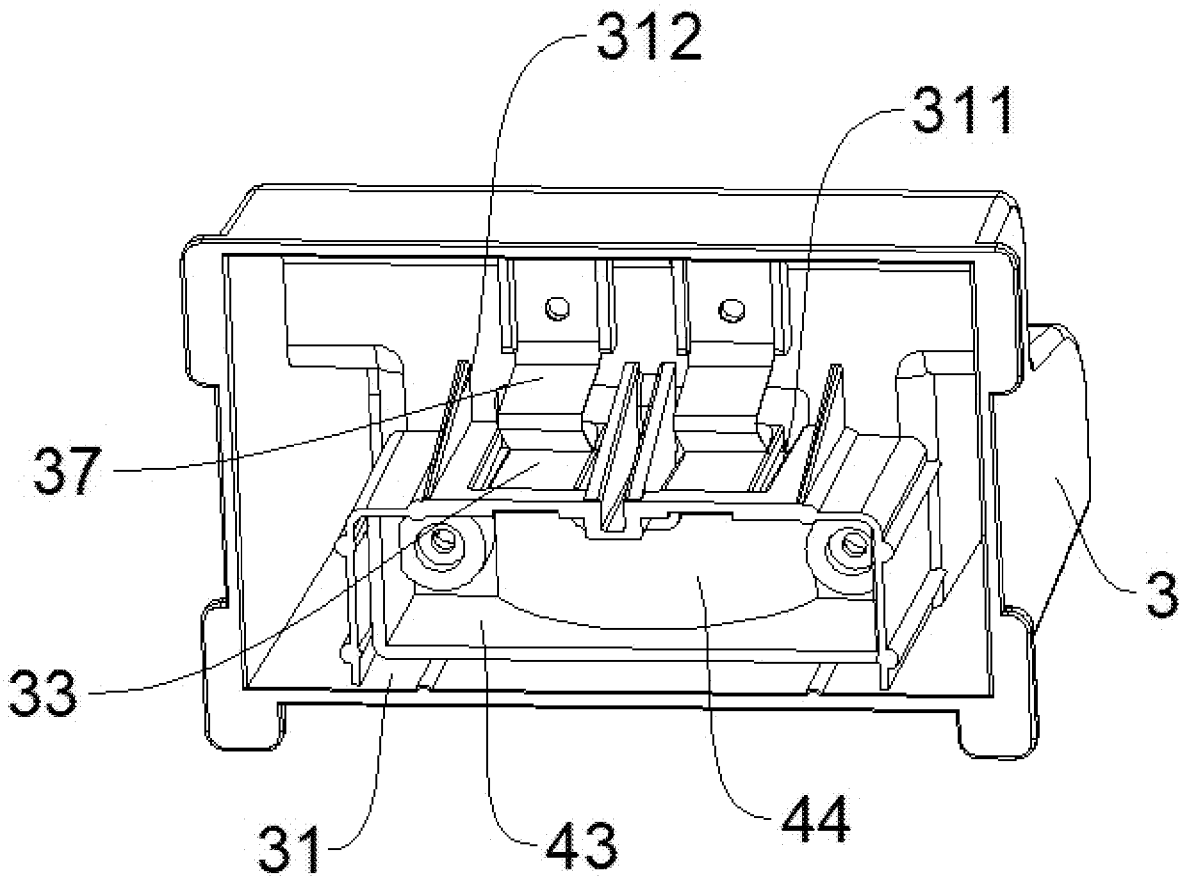
FIG. 6 is a schematic structural diagram of a bottom of the fixed seat.
Figure 7:
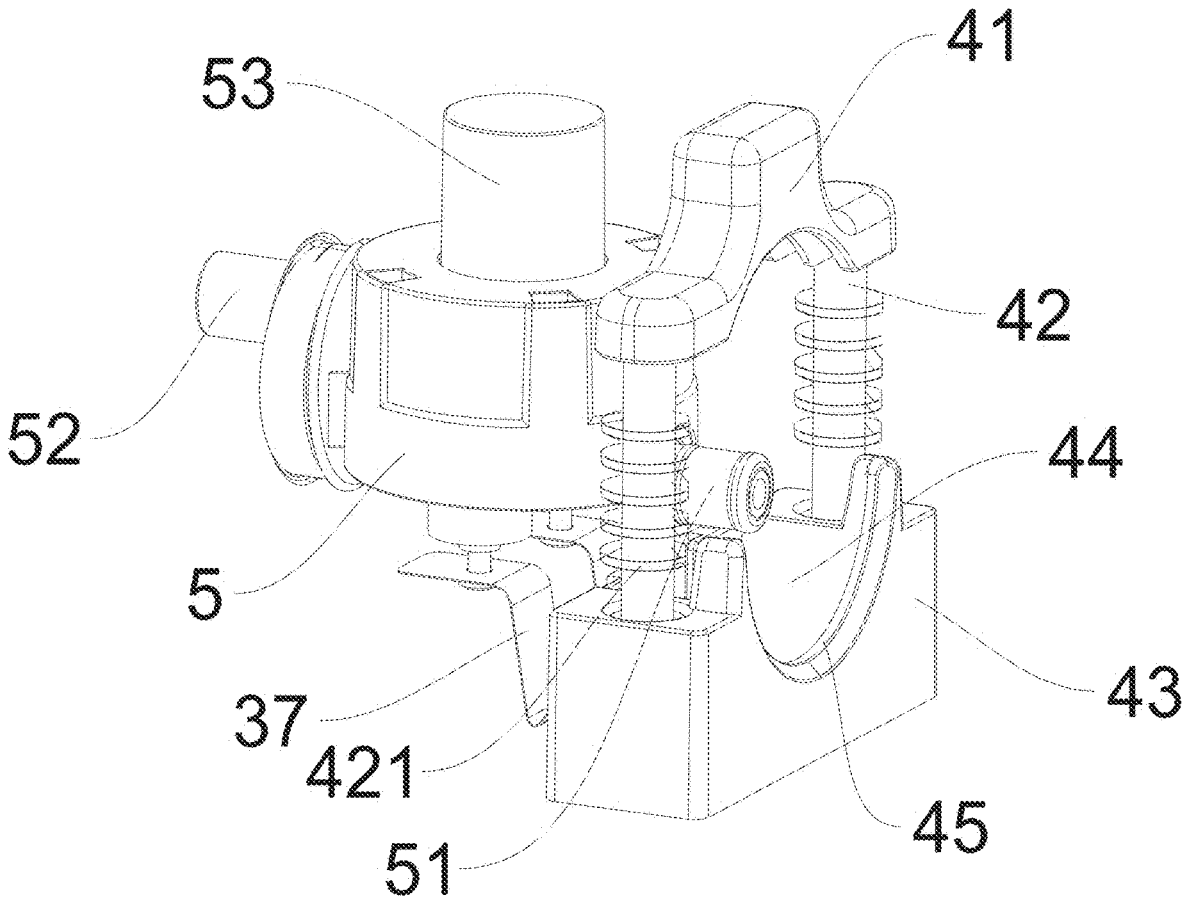
FIG. 7 is a schematic diagram of positions of the pump head and the lifting mechanism.

In the present embodiment, as shown in FIG. 5 and FIG. 6, a metal elastic sheet 37 is installed at a bottom of the fixed seat 3, and the metal elastic sheet 37 abuts against the second elastic piece 33.

Specially, an installation hole 34 is provided on one side, far away from the clamping block 43, of the fixed seat 3, and the metal elastic sheet 37 and the pump head 5 are installed at the upper end and the lower end of the installation hole 34 respectively.

In the present embodiment, the second elastic piece 33 is an L-shaped sheet body, and the metal elastic sheet 37 provides elasticity for the L-shaped sheet body. After the liquid storage bottle 2 is pulled away from the pump head 5, a top end of the L-shaped sheet body is pushed to be clamped on the clamping wall 46 by means of the elasticity of the metal elastic sheet 37, so that the limiting of the clamping seat 43 may be completed.

In the present embodiment, as shown in FIGS. 3 to 6 and FIG. 9, positioning pins 36 are disposed at the bottom of the fixed seat 3, a plurality of positioning ribbed plates 13 are disposed at each of two sides of an inner cavity of a lower shell 12 of the shell 1, gaps are provided between the positioning ribbed plates 13 and a bottom wall of the lower shell 12, and the positioning pins 36 are clamped in the gaps between the positioning ribbed plates 13 and the lower shell 12.

Embodiment 5

On the basis of any of the above embodiments, the present embodiment provides an optional solution for a specific structure of the fixed seat.

In the present embodiment, as shown in FIG. 6, a groove wall, close to the clamping wall 46, on one side of the installation groove 31 is provided with a second installation hole 311, and the second elastic piece 33 passes through the second installation hole 311 to be connected to the clamping wall 46.

Two second installation holes 311, two third elastic pieces 33 and two metal elastic sheets 37 are included.

At least one of two sides of the second installation hole 311 is provided with a reinforcing rib 312.

In the present disclosure, unless otherwise explicitly stated or limited, the terms "installed", "connected", "connection", "fixed" and the like are to be interpreted in a broad sense, and may be, for example, a fixed connection, a detachable connection, integrated into a whole, a mechanical connection, an electrical connection, directly connected, or indirectly connected through an intermediate medium, and an internal communication of two components or an interactive relationship of two components. Those of ordinary skill in the art can understand the specific meaning of the above terms in the present disclosure according to the specific situation.

In the description of the present specification, reference to the description of the terms "one embodiment," some embodiments, "an example," a specific example, "some examples," and the like means that a particular feature, structure, material, or characteristic described in combination with the embodiment or example is included in at least one embodiment or example of the present disclosure. In the present specification, schematic expressions of the above terms are not necessarily directed to the same embodiment or example. Moreover, the particular feature, structure, material, or characteristic described may be combined in any suitable manner in any one or more embodiments or examples. Furthermore, different embodiments or examples and features of different embodiments or examples described in the present specification may be combined and incorporated by those skilled in the art without contradicting each other.

Although embodiments of the present disclosure have been shown and described above, it is to be understood that the above embodiments are illustrative and not restrictive of the present disclosure, and that variations, modifications, substitutions, and alterations to the above embodiments may be made by those skilled in the art within the scope of the present disclosure.

What is claimed is:

1. A soap dispenser with a detachable liquid storage bottle, comprising a shell, a fixed seat, a pump head, and the liquid storage bottle, wherein both the liquid storage bottle and the pump head are installed inside the shell, one end of the liquid storage bottle is provided with an opening, the end, provided with the opening, of the liquid storage bottle faces the pump head, the pump head is disposed on the fixed seat and comprises a liquid inlet pipe and a liquid outlet pipe, the liquid inlet pipe communicates with a cavity inside the liquid storage bottle, and the liquid outlet pipe has two ends, one end of the liquid outlet pipe being located inside the shell and the other end of the liquid outlet pipe being located outside the shell, wherein the soap dispenser further comprises a lifting mechanism, the liquid storage bottle comprises a positioning cover, the lifting mechanism is connected to the positioning cover in a repeatably detachable manner, the liquid storage bottle further comprises a butting pipe, and the liquid inlet pipe communicates with the liquid storage bottle via the butting pipe, and communicates with the butting pipe in a repeatably openable and closable manner;

wherein the lifting mechanism comprises a pressing block, a connecting rod, and a clamping seat, wherein the clamping seat is connected to the pressing block via the connecting rod, the pressing block is fixedly connected to the fixed seat, the clamping seat is located inside the fixed seat, the pressing block is movably connected to the clamping seat via the connecting rod, the connecting rod passes through the fixed seat, the positioning cover is installed on a bottleneck of the liquid storage bottle, and the positioning cover is located in an annular space enclosed by the connecting rod and the clamping seat;

the liquid storage bottle further includes a stop valve rod, the positioning cover is provided with a hole, the stop valve rod passes through one end of the hole in the positioning cover to be connected to the liquid inlet pipe, and the other end of the stop valve rod is located inside the liquid storage bottle;

the liquid storage bottle further includes a third elastic piece, the stop valve rod is connected to the butting pipe via the third elastic piece, and the stop valve rod is movable along an axial direction; and when the stop valve rod keeps away from the butting pipe, the liquid inlet pipe communicates with the butting pipe, and when the stop valve rod abuts against the butting pipe, the liquid inlet pipe does not communicate with the butting pipe.

2. The soap dispenser with a detachable liquid storage bottle according to claim 1, wherein the fixed seat comprises at least one second elastic piece, the at least one second elastic piece is clamped on one side, far away from the liquid storage bottle, of a top surface of the clamping seat, and the lifting mechanism further comprises a first elastic piece, one end of the first elastic piece abutting against the pressing block and the other end of the first elastic piece abutting against the fixed seat.

3. The soap dispenser with a detachable liquid storage bottle according to claim 2, wherein a middle part of the top surface of the clamping seat is provided with an arc area, the at least one second elastic piece is clamped on one side of the arc area, and a clamping bulge is disposed on the other side of the arc area; and the positioning cover is disposed on the bottleneck of the liquid storage bottle, the positioning cover is located in the arc area and abuts against the at least one second elastic piece, and the clamping bulge is located between the positioning cover and a bottle body of the liquid storage bottle and abuts against the bottleneck.

4. The soap dispenser with a detachable liquid storage bottle according to claim 3, wherein a clamping wall is disposed on one side, far away from the clamping bulge, of the arc area, and the at least one second elastic piece is clamped on the clamping wall.

5. The soap dispenser with a detachable liquid storage bottle according to claim 4, wherein the clamping seat comprises a positioning groove, and one end, connected to the clamping seat, of the connecting rod is located in the positioning groove.

6. The soap dispenser with a detachable liquid storage bottle according to claim 2, wherein at least one metal elastic sheet is installed at a bottom of the fixed seat, and the at least one metal elastic sheet abuts against the at least one second elastic piece.

7. The soap dispenser with a detachable liquid storage bottle according to claim 2, wherein an installation groove is disposed at a bottom of the fixed seat, and the clamping seat is slidably installed in the installation groove.

8. The soap dispenser with a detachable liquid storage bottle according to claim 7, wherein a groove wall, close to the clamping wall, on one side of the installation groove is provided with at least one second installation hole, and the at least one second elastic piece passes through the at least one second installation hole to be connected to the clamping wall.

9. The soap dispenser with a detachable liquid storage bottle according to claim 8, wherein the at least one second installation hole is a plurality of second installation holes, and at least one of two sides of each of the second installation holes is provided with a reinforcing rib.

10. The soap dispenser with a detachable liquid storage bottle according to claim 1, wherein the pump head comprises a pressing rod, a pressing plate is hinged to and installed on one end of an upper shell of the shell, and the pressing plate is in contact with the pressing rod.

11. The soap dispenser with a detachable liquid storage bottle according to claim 1, wherein positioning pins are disposed at a bottom of the fixed seat, a plurality of positioning ribbed plates are disposed on each of two sides of an inner cavity of a lower shell of the shell, gaps are provided between the positioning ribbed plates and a bottom wall of the lower shell, and the positioning pins are clamped in the gaps between the positioning ribbed plates and the lower shell.

12. The soap dispenser with a detachable liquid storage bottle according to claim 1, wherein a limiting shade is concentrically disposed on one side, far away from the pump head, of the butting pipe, the stop valve rod is disposed between the butting pipe and the limiting shade, and the third elastic piece is disposed between the stop valve rod and the limiting shade; and a plurality of liquid inlet holes are formed in the limiting shade, and liquid in the liquid storage bottle enters the butting pipe via the liquid inlet holes.

13. The soap dispenser with a detachable liquid storage bottle according to claim 12, the liquid storage bottle being capable of being automatically sealed when being taken down, wherein the stop valve rod comprises a conical section and a straight rod section, and an outer diameter of a large end of the conical section is greater than an inner diameter of the butting pipe; and one end, far away from the conical section, of the straight rod section penetrates through the limiting shade, a third elastic piece sleeves the straight rod section, and the third elastic piece is located between the limiting shade and the conical section.

14. The soap dispenser with a detachable liquid storage bottle according to claim 13, the liquid storage bottle being capable of being automatically sealed when being taken down, wherein the conical section further comprises an overflow section disposed on an end surface of a small end of the conical section; and an overflow groove is formed in the overflow section, an outer diameter of the overflow section is equal to an inner diameter of the butting pipe and is located in the butting pipe, and when the liquid storage bottle is installed on the pump head, a pipe orifice of the liquid inlet pipe communicates with an inside of the liquid storage bottle via the overflow groove.

15. The soap dispenser with a detachable liquid storage bottle according to claim 14, the liquid storage bottle being capable of being automatically sealed when being taken down, wherein the first elastic piece and/or the third elastic piece are spring devices.

16. The soap dispenser with a detachable liquid storage bottle according to claim 15, the liquid storage bottle being capable of being automatically sealed when being taken down, wherein the fixed seat comprises an installation hole, the metal elastic sheet is fixedly connected to a bottom of the installation hole, and the pump head is fixedly connected above the installation hole.

* * * * *